US006015313A

United States Patent [19]

Davis et al.

[11] Patent Number: 6,015,313

[45] Date of Patent: Jan. 18, 2000

[54] LAMP ASSEMBLY

[75] Inventors: Wayne Samuel Davis, Harrisburg; Robert Neil Whiteman, Jr., Middletown; Christopher Scott Leaman, Elizabethtown, all of Pa.

[73] Assignee: The Whitaker Corporation, Wilmington, Del.

[21] Appl. No.: 08/877,048

[22] Filed: Jun. 17, 1997

[51] Int. Cl.[7] ..... H01R 4/24

[52] U.S. Cl. ..... 439/419; 439/404; 439/620; 362/226; 362/240

[58] Field of Search ..... 439/419, 404, 439/620, 552, 332, 336, 337; 362/226, 85, 244, 240

[56] References Cited

U.S. PATENT DOCUMENTS

| | | | |
|---|---|---|---|
| 4,153,325 | 5/1979 | Asick | 439/392 |
| 4,181,393 | 1/1980 | Lill | 439/402 |
| 4,466,050 | 8/1984 | Lockard | 362/307 |
| 5,309,634 | 5/1994 | Van Order et al. | 29/863 |
| 5,397,251 | 3/1995 | Kaminski | 439/620 |
| 5,403,195 | 4/1995 | Thrush et al. | 439/69 |
| 5,420,762 | 5/1995 | Lewis | 362/61 |
| 5,439,384 | 8/1995 | Thrush et al. | 439/69 |
| 5,484,186 | 1/1996 | Van Order et al. | 296/97.5 |
| 5,647,761 | 7/1997 | Kaminski | 439/620 |

OTHER PUBLICATIONS

Jemco Catalog, pp. 8–10; (date unknown); Jemco Engineering Co.,Minooka, IL.

General Electric Drawing No. 205C1154 Sheet 1, 1988; General Electric, Louisville, KY.

General Electric Drawing No. 205C1154 Sheet 2, 1989; General Electric, Louisville, KY.

*Primary Examiner*—Steven L. Stephan
*Assistant Examiner*—T C Patel
*Attorney, Agent, or Firm*—Katherine A. Nelson

[57] ABSTRACT

Lamp assembly (10) including an array of lamps (44) connectable to electrical power sources by contacts (40,42), and aligned with lenses (14) of a display panel (12) upon mounting of the lamp assembly to the panel, to illuminate the lenses. Contacts (40,42) terminate the lamp leads (46, 48), and common contact (42) commons all the lamps. Housing (30) enables dressing the lamp leads for termination by contacts (40,42) and accommodates resistors (50) on certain lamp leads (46).

28 Claims, 7 Drawing Sheets

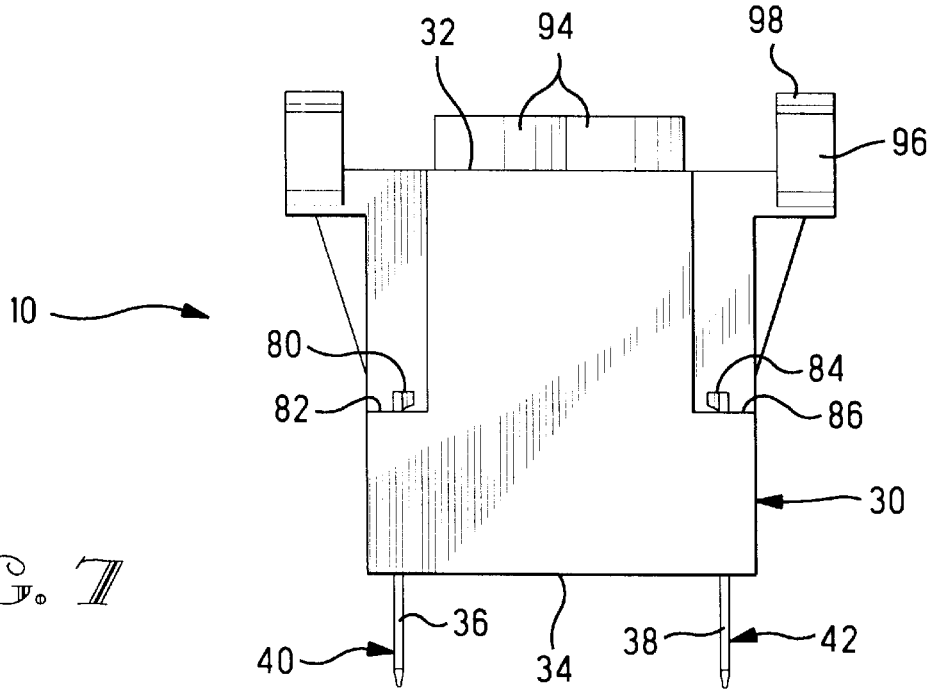
FIG. 7
FIG. 8
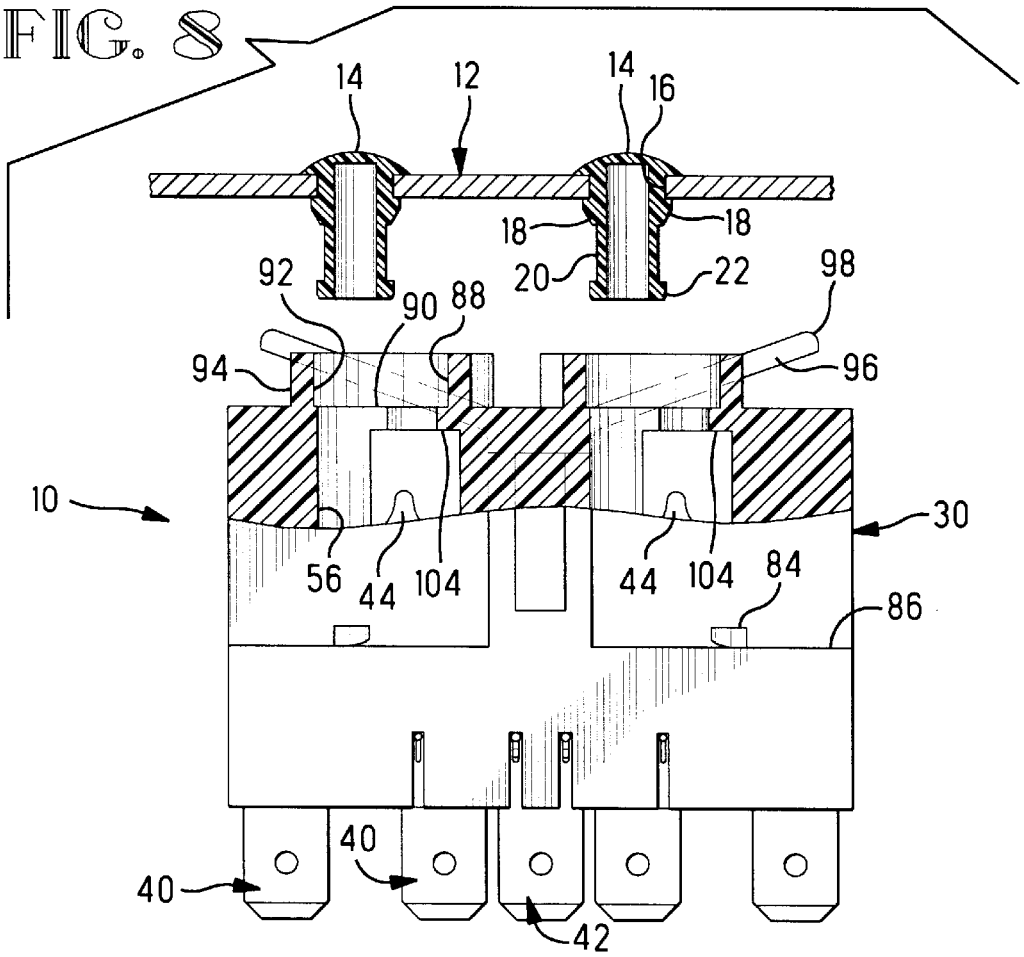

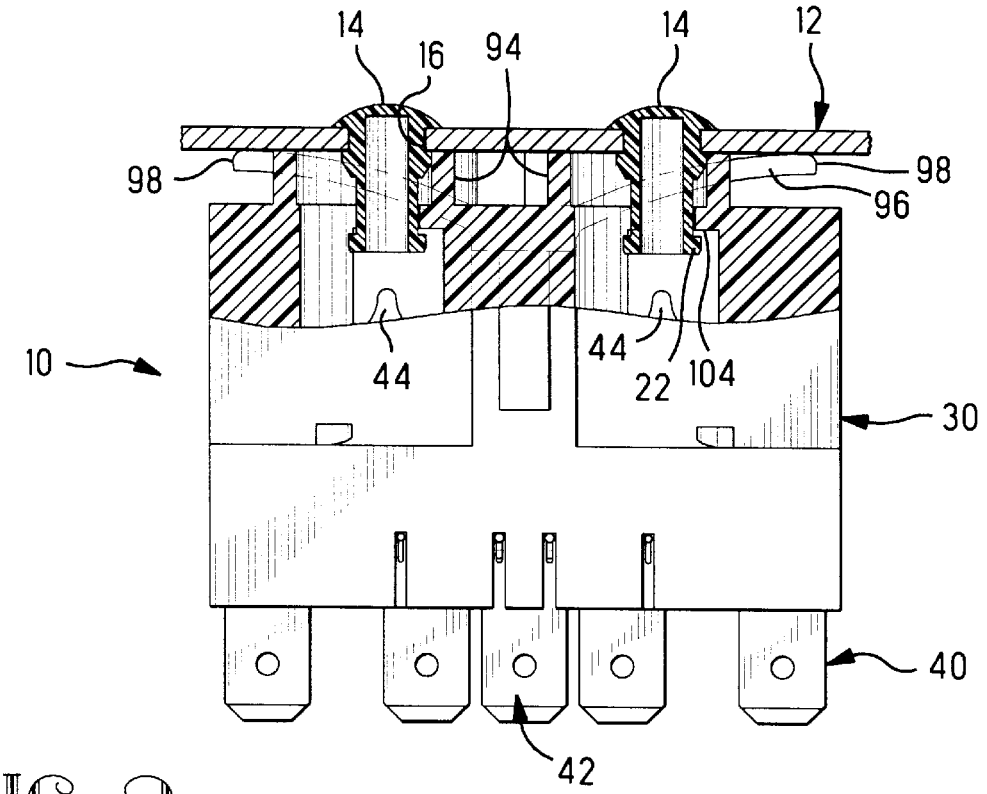
FIG. 9
FIG. 10
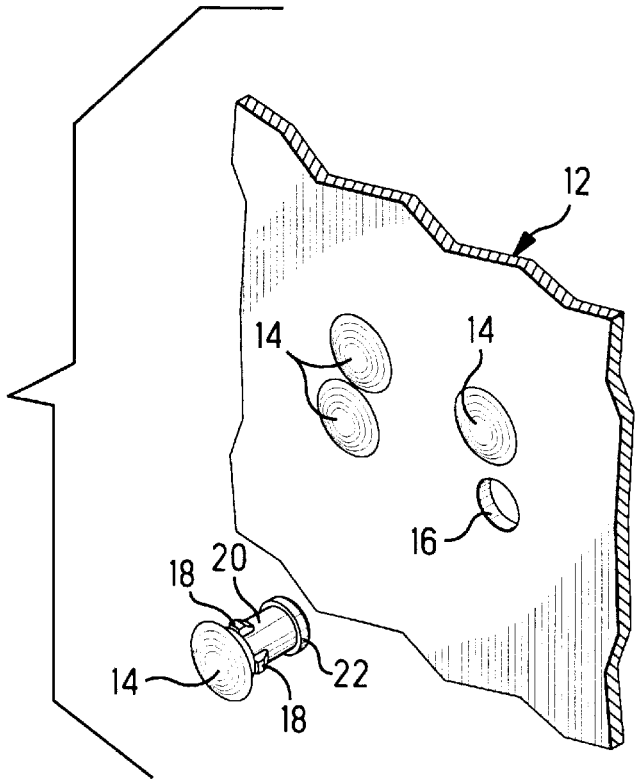

LAMP ASSEMBLY

FIELD OF THE INVENTION

The present invention relates to the field of electrical connections and more particularly to assemblies containing lamps.

BACKGROUND OF THE INVENTION

In certain appliances, such as electric ranges, where display panels are utilized to signify that electrical power is being transmitted to portions thereof, lamps are used that illuminate specific indicators on the panel. The lamps are individually energized and require transmission of electrical power thereto. Heretofore, pairs of discrete conductor wires have been connected to each lamp, which is mounted to a rear face of the panel.

It is desired to provide an assembly of a plurality of lamps mountable as a unit to the display panel, with the assembly adapted for electrical connection of discrete wires to leads of the lamps.

SUMMARY OF THE INVENTION

A housing of the present invention has a mounting face and an opposed assembly face, with lamps insertable into the housing from the assembly face and respective openings along the mounting face to permit illumination by the lamps of respective lenses of a display panel of an appliance when the assembly is mounted to a rear face of the display panel internal to an appliance, with the mounting face adjacent thereto and the openings permitting alignment of the lamps with the lenses. The housing includes contact members associated with the lamps to permit subsequent connection to respective wires thereto, or circuits of a cable connector, after the assembly is mounted in the appliance such as by having contact sections exposed along a face of the housing. The assembly face preferably provides for dressing of the lamp leads for termination of the leads to the contact members, and also preferably provides for incorporation of resistors secured to a lead of each lamp, into the assembly. Additionally, the assembly preferably includes a single common contact for connecting the common leads of each lamp, requiring only a single conductor.

In another aspect of the invention, the contacts establish electrical connections with the lamp leads upon insertion, and also serve to retain the lamps in the housing.

In a further aspect of the invention, the lamp assembly is mountable to the display panel at the lens array by securing itself to enlarged ends of the lenses received into the mounting face openings when the housing is biased against the panel surface by resilient sections, so that no fasteners are required.

An embodiment of the invention will now be described by way of example with reference to the accompanying drawings.

BRIEF DESCRIPTION OF THE DRAWINGS

FIG. 7 is an elevation view of a second side of the assembly;

FIGS. 8 and 9 are partial longitudinal section views of the assembly during mounting to a panel having lenses secured thereto, and after mounting, respectively;

FIG. 10 is a representative view of a panel to which a lens is being secured in a first configuration.

DETAILED DESCRIPTION

Figure 11:
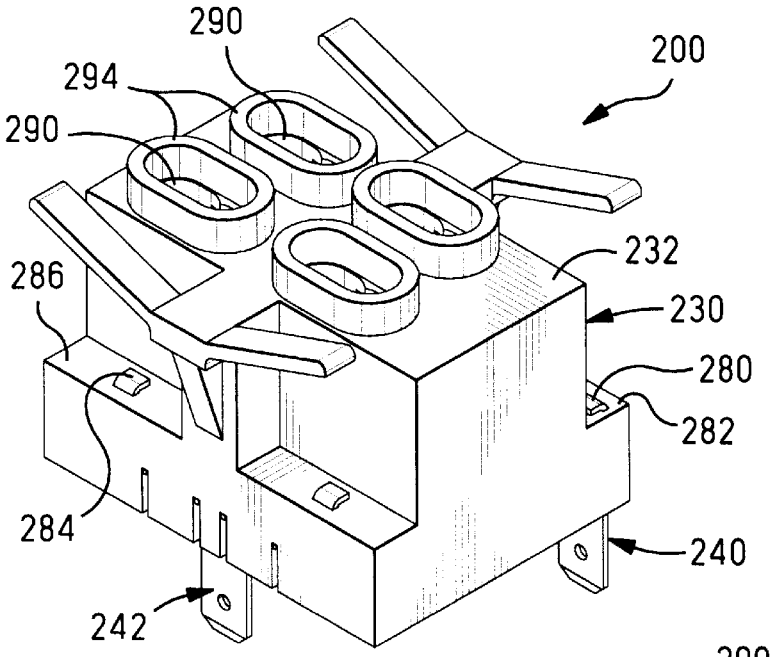
FIGS. 11 to 13 are an isometric view and a plan view of the mounting face of a second embodiment of the assembly, and a panel having a second lens configuration, with the assembly adapted to accommodate the second lens configuration.
Figure 12:
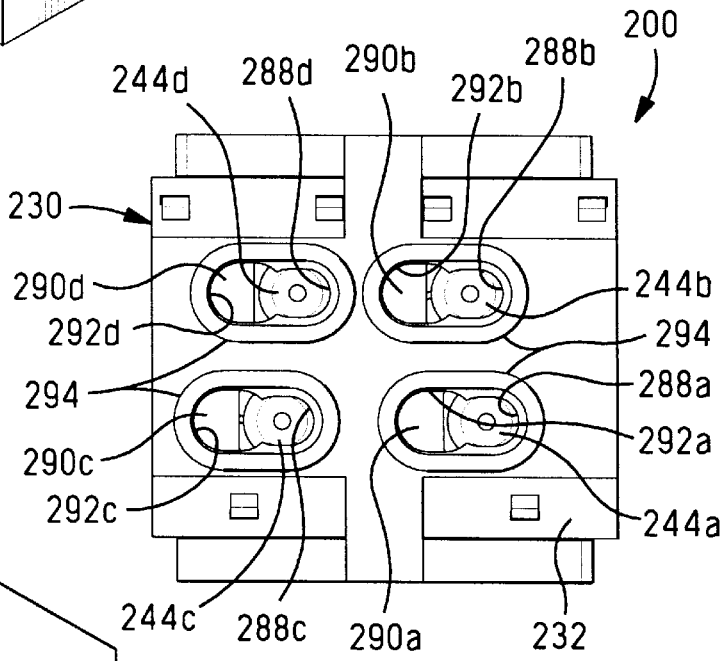

FIGS. 1 to 9 disclose a first embodiment of the present invention, with assembly 10 adapted to be utilized with a display panel 12 having an array of lenses 14 in a first configuration shown in FIG. 10 secured through apertures 16 through panel 12. FIGS. 11 and 12 disclose a second embodiment of assembly 200 adapted to be utilized with a display panel 212 having an array of lenses 214 in a second configuration shown in FIG. 13. Lenses 14 (FIGS. 8 to 10) each are of the type that include an array of embossments 18 that snap behind panel 12 when the lenses are inserted through the apertures 16, and have shafts 20 that protrude from panel 12 to annular collars 22 at ends thereof.

Assembly 10 includes a housing 30 defining a mounting face 32 and an assembly face 34 opposed to the mounting face, with mounting face 32 to be adjacent the display panel 12 upon mounting thereto. Assembly face 34 is adapted to permit assembly of the lamp and contact components into the housing and also to constitute a mating face for providing electrical connections with contact sections 36,38 of contacts 40,42 of the assembly by complementary contacts during subsequent wiring of the appliance. Lamps 44 each include a pair of leads 46,48 extending therefrom for connection to contacts 40,42, and each lamp 44 includes a resistor component 50 defined along larger diameter lead 46 thereof. Each lamp is being electrically connected to a power contact 40 and a common contact 42 by leads 46,48 being terminated to termination sections 52,54 of contacts 40,42.

Figure 3:
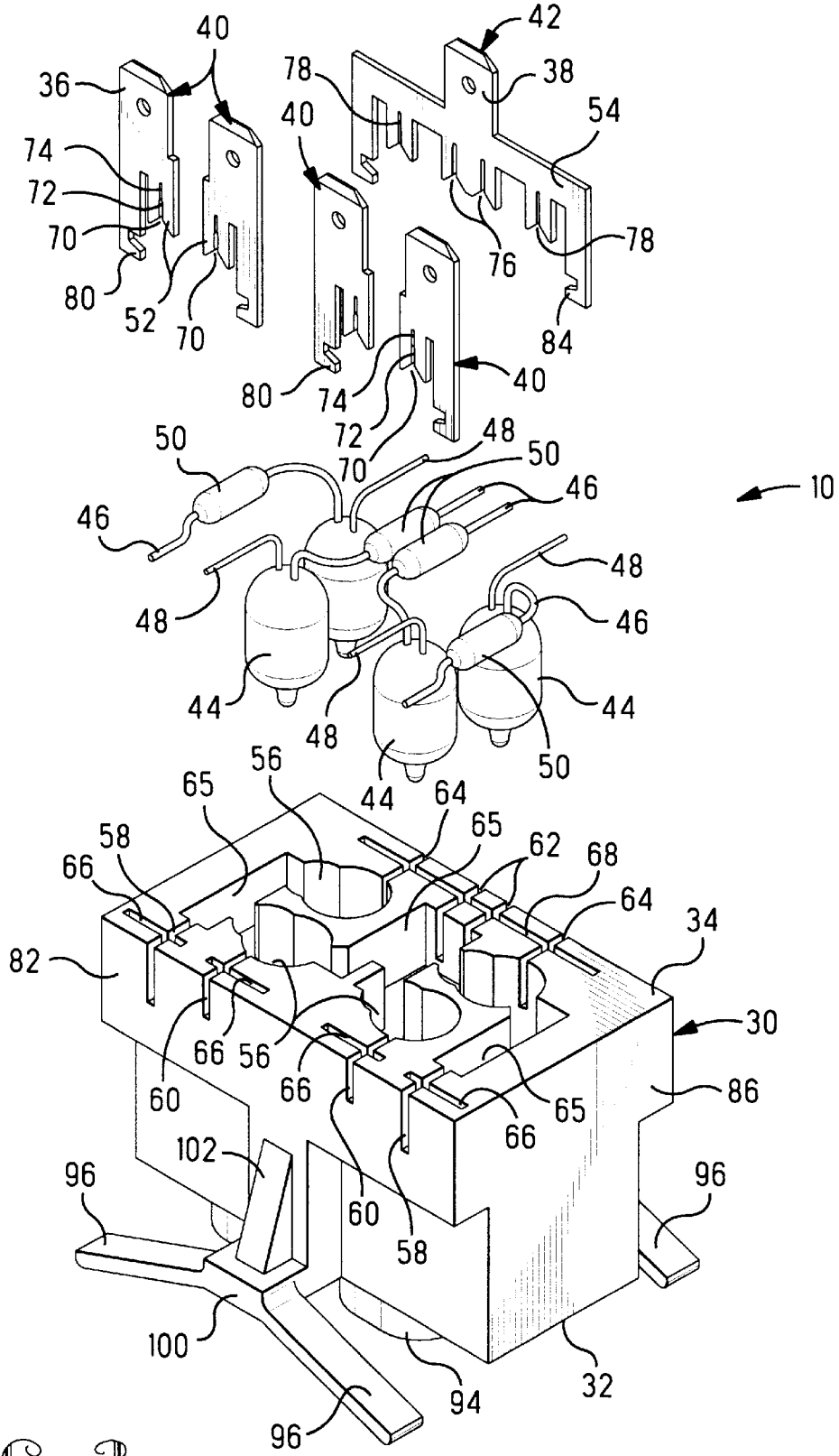
FIG. 3 is an exploded isometric view of the assembly of FIG. 1.
Figure 5:
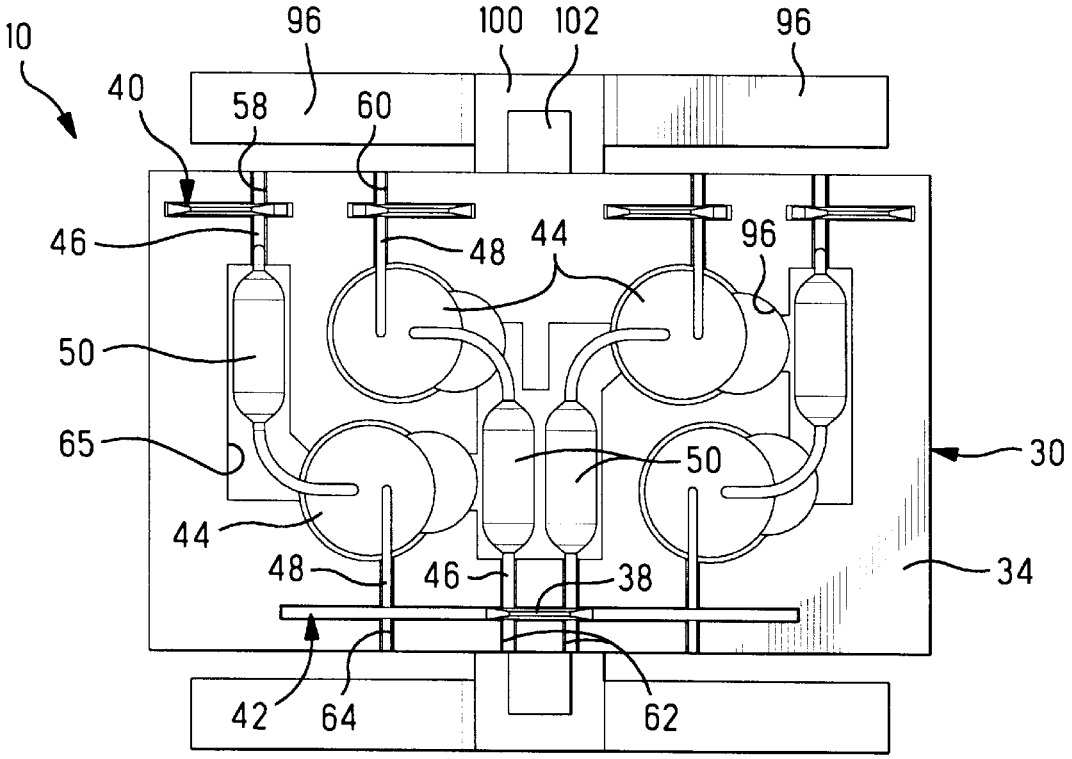
FIGS. 5 and 6 are plan views of the assembly face and the mounting face of the assembly of FIGS. 1 to 4, respectively.

As illustrated in FIGS. 3 and 5, each lamp is inserted into a respective aperture 56 along assembly face 34, with leads 46,48 thereof dressed into lead-receiving slots 58,60,62,64 in communication with aperture 56. Resistor 50 is received into a respective recess 65 along one of slots 58,62. Contacts 40 are then inserted into contact-receiving slots 66 each transverse to a respective lead-receiving slot 58,60 with contact-receiving slots 66 preferably coaligned along one side of the assembly face. Common contact 42 is inserted into contact-receiving slot 68 along the opposed side of the assembly face, transversely intersecting all the lead-receiving slots 62,64.

In the embodiment shown, four lamps are assembled into assembly 10, with the outermost two thereof containing leads dressed adjacent opposed ends of housing 30, while the innermost two thereof contain leads dressed inwardly thereof. It can be seen that leads 46 of the outermost lamps contain resistors 50 and are larger diameter leads and are disposed in respective lead-receiving slots 58 for leads 46 of the innermost lamps that do not include resistors 50, with slots 58 being deeper than_lead-receiving slots 60. Shallow slots 60 support the smaller diameter leads 48 closer to the assembly face. Portions of the lamp leads projecting from the sides of housing 30 may be severed after assembly.

Figure 4:
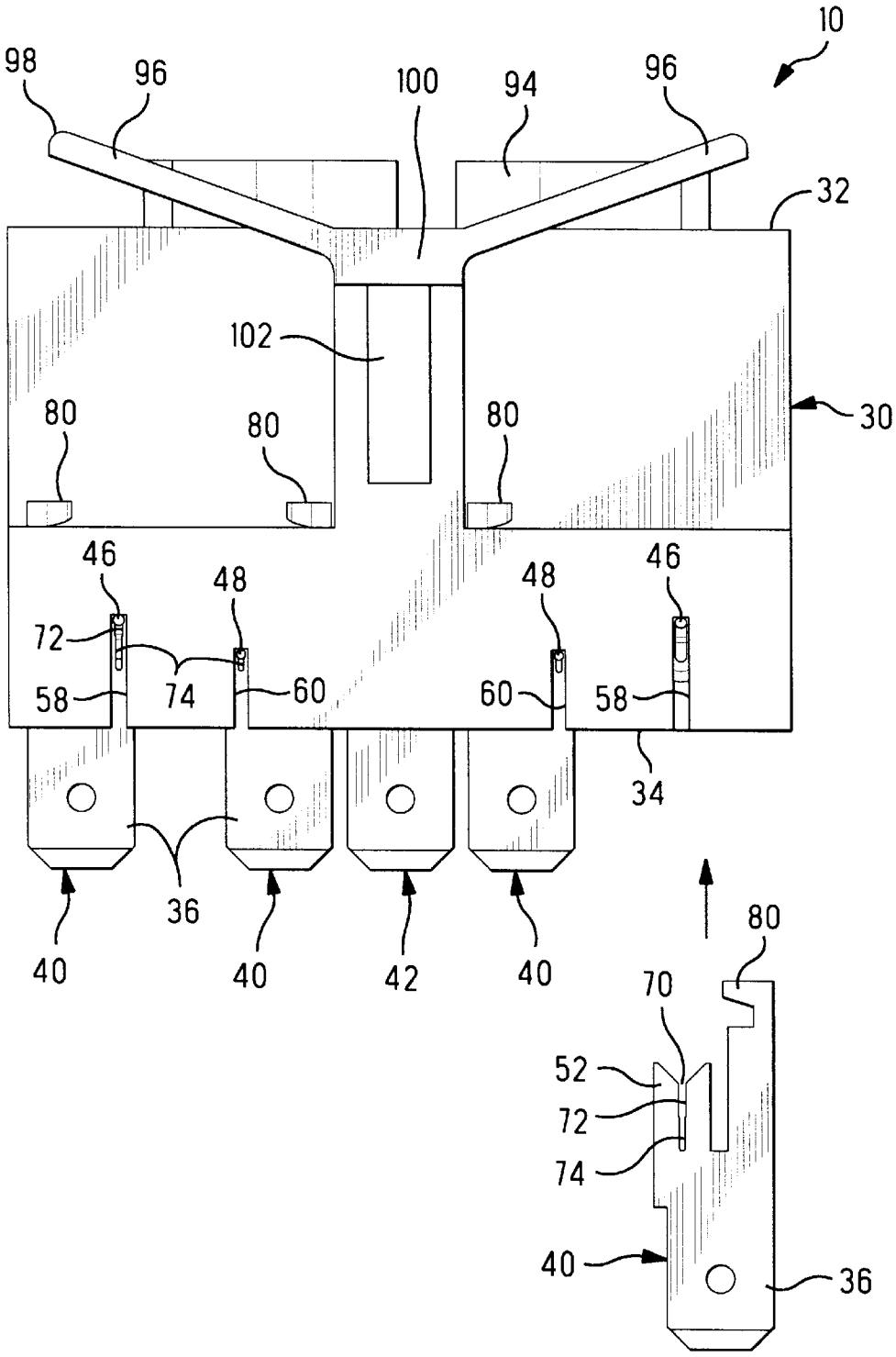
FIG. 4 is an elevation view of the assembly of FIGS. 1 to 3 from a first side thereof, illustrating assembly of a contact thereinto to terminate a lamp lead.

During contact insertion subsequent to lamp insertion and best seen in FIG. 4, the termination section 52 of each of contacts 40 receives a respective lead into a lead-terminating slot 70 thereof that is aligned with the associated lead-receiving slot of the housing, which establishes an assured electrical connection with the respective lead by compressing opposed sides of the lead. Termination sections 52 accommodate different diameter leads, since the lead onto which the resistor 50 is affixed is conventionally larger in diameter than the other lead of each lamp. Larger diameter leads 46 of the outermost lamps are received into larger width portions 72 of slots 70 proximate the slot entrances, while smaller diameter leads 48 of the innermost lamps are urged further into the slots 70 until received into smaller width slot portions 74 inwardly from the slot entrances by reason of being supported by bottom walls of shallow lead-receiving slots 60 as contacts 40 are urged fully into contact-receiving slots 66.

Figure 1:
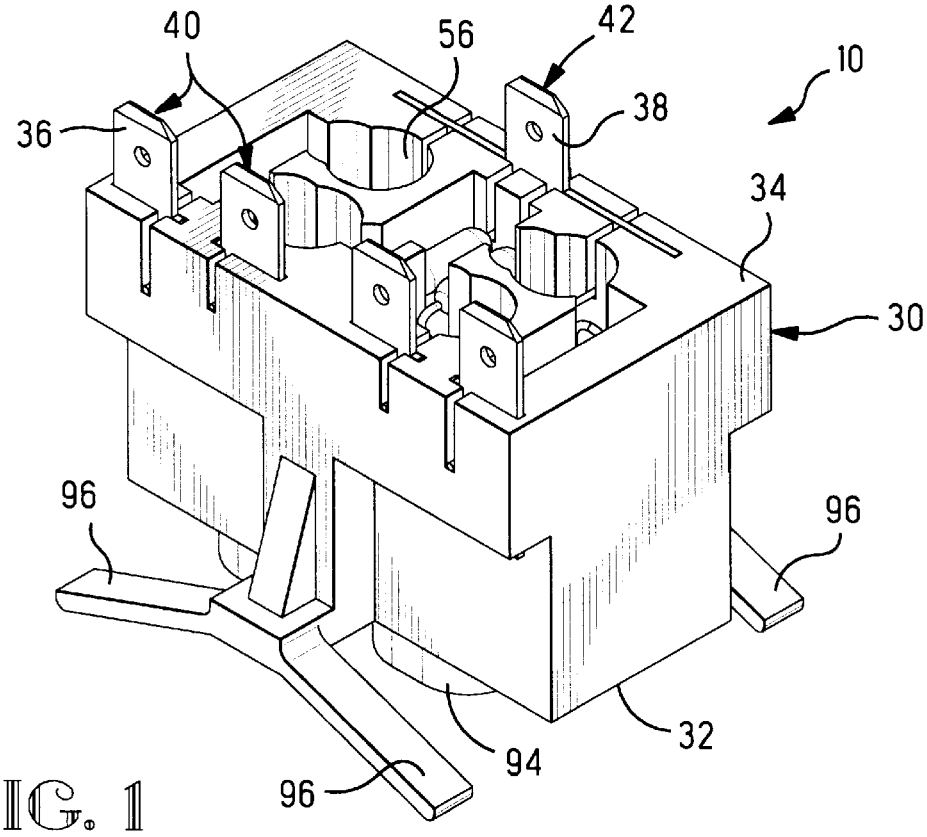
FIGS. 1 and 2 are isometric views of a first embodiment of the assembly of the present invention from the assembly face and the mounting face, respectively.
Figure 2:
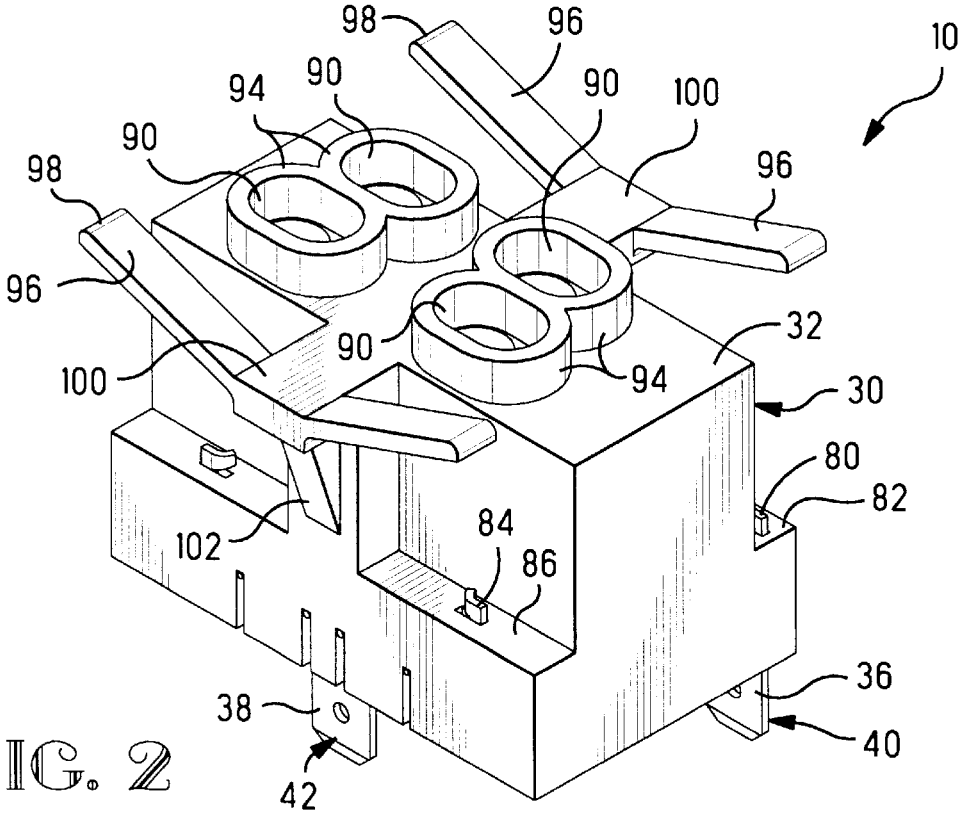
Figure 6:
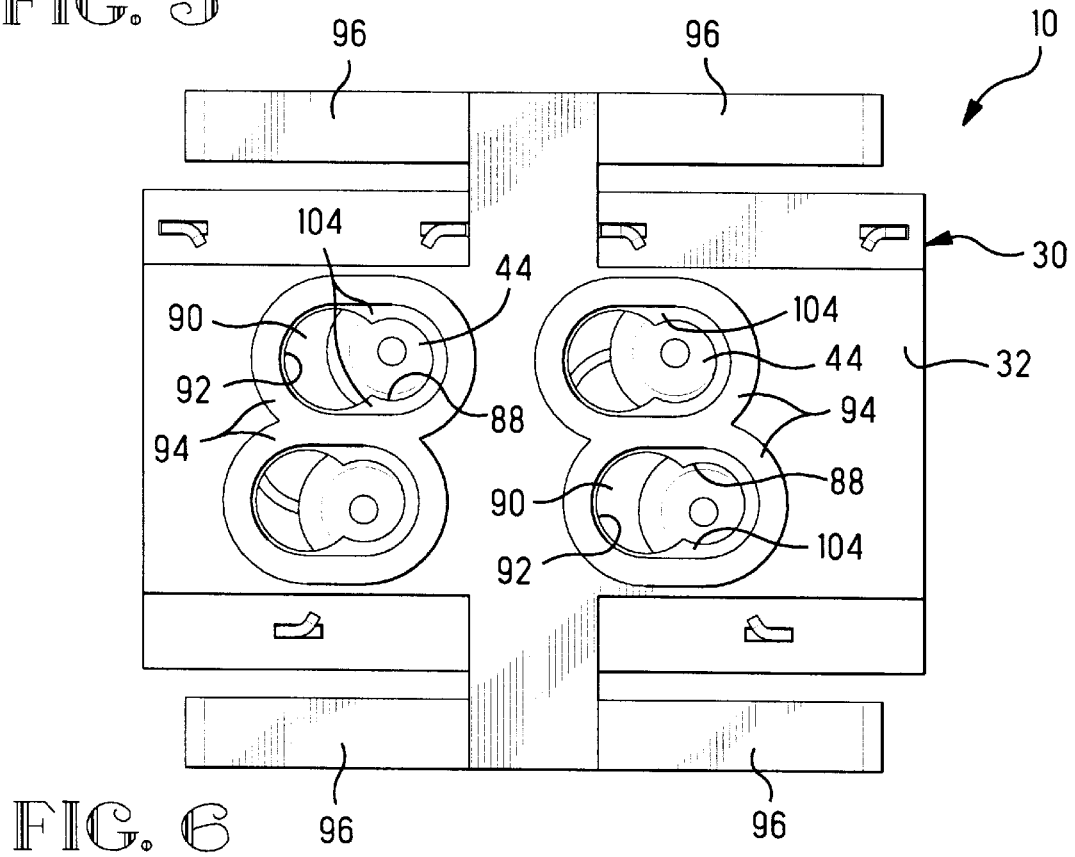

Similarly with respect to common contact 42 (FIG. 3), lead-terminating slots 76 are larger in width than lead-terminating slots 78 to receive thereinto larger diameter leads 46 disposed in inner lead-receiving slots 62 while smaller diameter leads 48 in outer lead-receiving slots 64 are received into lead-terminating slots 78. Contacts 40 each include an initially straight retention tab 80 that protrudes through a lateral flange 82 of housing 30 whereafter it is bent as shown in FIGS. 2 and 6. Similarly, common contact 42 includes a pair of initially straight retention tabs 84 that protrude through a lateral flange 86 of housing 30 whereafter they are bent.

After assembly of assembly 10, referring to FIG. 6, lamps 44 are fixed in position in alignment with smaller dimensioned portions 88 of openings 90 along mounting face 32 laterally from which extend larger dimensioned portions 92 in a common direction toward one end of housing 30. Large dimensioned entrance portions 92 are just larger than annular collar 22 of a lens 14, comprising an enlarged lens end. Small dimensioned entrance portion 88 is defined and surrounded by a ledge 104 extending from large dimensioned entrance portion 92, and is smaller than annular lens collar 22 and just larger than lens shaft 20. Entrances to lens-receiving openings 90 are surrounded by embossments 94 that extend outwardly of mounting face 32 (FIGS. 2 and 7 to 9).

Referring now to FIGS. 2, 8 and 9, mounting face 32 of housing 30 also defines a plurality of resilient sections 96 engageable at leading ends 98 with the adjacent surface of the display panel 12 prior to abutment of embossments 94 with the panel surface, deflecting the resilient sections thereafter so that they act as springs generating force against the panel. The resilient sections 96 are shown to be integral spring arms of the housing extending forwardly and laterally from base portions 100. Preferably base portions 100 have buttresses 102 for strengthening. Rearward ends of lenses 14 are received into embossments 94 and into large dimensioned portions 92 of openings 90.

Thereafter, assembly 10 is moved laterally so that shafts 20 of lenses are translated into small dimensioned entrance portions 88, and annular collars 22 at ends of lens shafts 20 seat and secure behind ledges 104 associated with small dimensioned portions 88 of openings 90, and lenses 14 are now generally aligned with lamps 44. Upon mounting of assembly 10 to the display panel, embossments 94 abut the panel surrounding each lens 14 to exclude ambient light from undesirably illuminating the lenses, including especially light from lamps 44 associated with any of the other lenses 14. With annular collars 22 seated behind ledges 104, the assembly 10 is secured to display panel 12 by lenses and resilient sections 96 in a manner that permits ease of removal for repair and service but otherwise remains in place when contacts are electrically connected to contact sections 36,38 of the contacts of the assembly.

One example of material from which housing 30 may be molded, is nylon resin such as ZYTEL 101L sold by E. I. DuPont de Nemours & Co., Inc. Contacts 40 and 42 are easily stamped from sheet metal such as brass. Lamps 44 are conventionally available, such as A1C neon indicator lamps sold by Chicago Miniature Lamp, Inc., with 15K-ohm resistors incorporated onto one lead thereof. The lamps of the assembly are of the type being powered by AC current such as of 4 milliamps. The lenses are conventionally available and may be plastic, such as of polycarbonate resin and sold by JEMCO Engineering Co., Minnooka, Ill. as Minilens having Part No. LO5-0041-J230.

FIG. 10 shows that the lenses are positioned in a generally trapezoidal configuration in the display panel. Openings 90 are complementary to the trapezoidal lens pattern, with centers of the large dimensioned entrance portions 92 spaced to coincide in a likewise trapezoidal pattern. Similarly, centers of the small dimensioned entrance portions 88, and lamps 44, are also spaced and positioned in the trapezoidal pattern.

Figure 13:
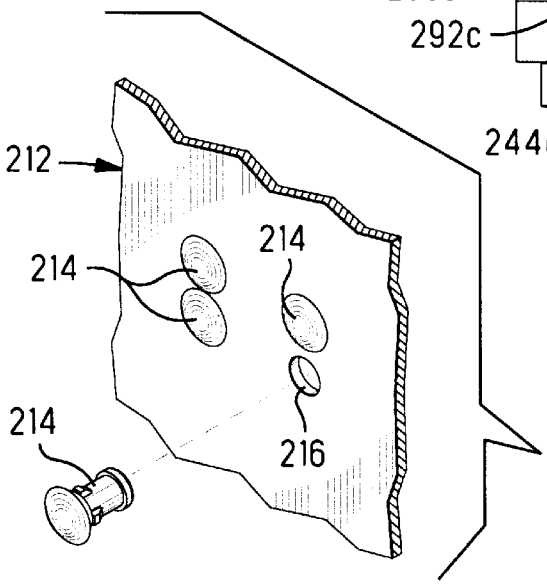

FIGS. 11 and 12 show a second embodiment of the lamp assembly 200 of the present invention that not only accommodates the trapezoidal pattern of FIG. 10 but also accommodates a rectangular configuration of lenses 214 in holes 216 of display panel 212 as shown in FIG. 13. In FIG. 11 it is seen that retention tabs 280,284 of contacts 240,242 are bent over to lie flush against the surface of lateral flanges 282,286 after contacts 240,242 are fully inserted into housing 230 from assembly face 234.

In FIG. 12 is seen mounting face 232 that includes embossments 294 surrounding lens-receiving apertures 290. Each aperture 290 includes an elongated larger dimensioned entrance portion 292, and an elongated smaller dimensioned entrance portion 288 in which lamp 244 is seen. It will be observed that the elongation of the entrance portions accommodates not only the trapezoidal lens pattern of FIG. 10 but also the rectangular lens pattern of FIG. 13. Considering the lens-receiving apertures 290*a*,290*b* along the right side of housing 230 in FIG. 12, since the left side of the larger dimensioned entrance portion 292*a* of the lower aperture 290*a* is aligned with the right side of the larger dimensioned entrance portion 292*b* of the upper aperture 290*b*, lenses of either pattern will be received thereinto. Upon subsequent translation of assembly 200 to the left, the lenses of either pattern will be received into smaller dimensioned entrance portions 288*a*,288*b* and both be generally aligned with lamps 244*a*,244*b* respectively sufficiently for effective light transmission thereto. Regarding lens-receiving apertures 290*c*,290*d* along the left side, similar considerations apply.

Variations and modifications may be made to the particular embodiments disclosed herein that are within the spirit of the invention and the scope of the claims. For example, other retention mechanisms may be used to secure the lamp assembly to the display panel; other resilient members could be utilized; different contact retention means could be incorporated; and so forth.

What is claimed is:

1. A lamp assembly comprising:

an insulative housing having a mounting face and an opposed assembly face and including at least one lamp-receiving aperture extending from said assembly face to entrances along said mounting face;

a lamp insertable into each said at least one lamp-receiving aperture and having a pair of leads; and a power contact associated with each said lamp and having a terminating section connected to one of said leads, and a common contact associated with the other of said leads and including a terminating section connected thereto, each said power and common contact including a contact section exposed for electrical connection to external power sources for powering said lamps;

each said entrance of said at least one lamp-receiving aperture being at least sufficiently open to permit illumination of a respective lens of a display panel to which the lamp assembly is to be mounted;

said housing including resilient sections coextending from said mounting face to free ends engageable with the panel upon moving of said lamp assembly thereagainst for deflection of said resilient sections, whereafter said resilient sections maintain bias against the panel.

2. The lamp assembly of claim 1 wherein said lamp assembly includes embossments surrounding each said lens upon mounting of the lamp assembly to the panel, to exclude light therefrom from sources other than the lamp associated with said lens, said embossments concluding in coplanar leading ends to abut the panel.

3. The lamp assembly as set forth in claim 1 wherein said resilient sections are cantilever beams integral with said housing extending from bases along opposed sides of said housing forwardly from said mounting face and angled laterally to said free ends.

4. A lamp assembly comprising:

an insulative housing having a mounting face and an opposed assembly face and including at least one lamp-receiving aperture extending from said assembly face to entrances along said mounting face;

a lamp insertable into each said at least one lamp-receiving aperture and having a pair of leads; and a power contact associated with each said lamp and having a terminating section connected to one of said leads, and a common contact associated with the other of said leads and including a terminating section connected thereto, each said power and common contact including a contact section exposed for electrical connection to external power sources for powering said lamps;

each said entrance of said at least one lamp-receiving aperture being at least sufficiently open to permit illumination of a respective lens of a display panel to which the lamp assembly is to be mounted, each said lamp-receiving aperture entrance being adapted to receive an end of a respective lens thereinto;

each said entrance including a larger dimensioned entrance portion and a smaller dimensioned entrance portion, said larger dimensioned entrance portion adapted to receive thereinto an enlarged end of a respective said lens when the lamp assembly is being moved against said panel, and said smaller dimensioned entrance portion laterally of said larger dimensioned entrance portion is adapted to receive thereinto said enlarged lens end laterally thereinto, and said smaller dimensioned entrance portions of all said lamp-receiving aperture entrances extending laterally in a common direction from said larger dimensioned entrance portions enabling said housing to be urged laterally along said panel upon simultaneous receipt of said lens ends into said entrances.

5. The lamp assembly as set forth in claim 4 wherein each said enlarged lens end seats behind a ledge extending from said larger dimensioned entrance portion to mostly surround a respective said smaller dimensioned entrance portion.

6. The lamp assembly as set forth in claim 5 wherein said housing includes resilient sections coextending from said mounting face to free ends engageable with the panel upon moving of said lamp assembly thereagainst for deflection of said resilient sections, whereafter said resilient sections maintain bias against the panel and in cooperation with said enlarged lens ends seated behind said ledges, defines a mounting arrangement retaining the lamp assembly to the panel.

7. The lamp assembly as set forth in claim 4 wherein centers of said larger dimensioned entrance portions are spaced and positioned in a trapezoidal pattern to coincide with an identical trapezoidal pattern of said lenses mounted to said panel.

8. The lamp assembly as set forth in claim 7 wherein said larger dimensioned entrance portions are elongated extending away from said smaller dimensioned portions, and said smaller dimensioned portions are elongated extending away from said larger dimensioned portions, whereby lenses mounted in a rectangular pattern are receivable into said larger dimensioned entrance portions during lamp assembly mounting, and are slidable into said smaller dimensioned entrance portions, while the lamp assembly remains complementary to and usable with lenses mounted in said trapezoidal pattern.

9. The lamp assembly as set forth in claim 8 wherein each said enlarged lens end seats behind a ledge extending from said larger dimensioned entrance portion to mostly surround a respective said smaller dimensioned entrance portion.

10. The lamp assembly as set forth in claim 9 wherein said housing includes resilient sections coextending from said mounting face to free ends engageable with the panel upon moving of said lamp assembly thereagainst for deflection of said resilient sections, whereafter said resilient sections maintain bias against the panel and in cooperation with said enlarged lens ends seated behind said ledges, defines a mounting arrangement retaining the lamp assembly to the panel.

11. A lamp assembly comprising:

an insulative housing having a mounting face and an opposed assembly face and including at least one lamp-receiving aperture extending from said assembly face to entrances along said mounting face;

a lamp insertable into each said at least one lamp-receiving aperture and having a pair of leads; and a power contact associated with each said lamp and having a terminating section connected to one of said leads, and a common contact associated with the other of said leads and including a terminating section connected thereto, each said power and common contact including a contact section exposed for electrical connection to external sower sources for powering said lamps;

each said common contact including at least one lead-terminating slot in said termination section thereof enabling an assured electrical connection with a respective other of said lamp leads by compression thereagainst;

one said common contact having a said lead-terminating slot associated with a respective said other of said lamp leads of all said lamps;

each said entrance of said at least one lamp-receiving aperture being at least sufficiently open to permit illumination of a respective lens of a display panel to which the lamp assembly is to be mounted.

12. The lamp assembly as set forth in claim 11 wherein each said power contact includes a lead-terminating slot in said termination section enabling an assured electrical connection with a respective said one of said lamp leads by compression thereagainst.

13. The lamp assembly as set forth in claim 11 wherein said assembly face of said housing includes contact-receiving slots thereinto for each said power and common contact, and further includes a pair of lead-receiving slots in communication with each said lamp-receiving aperture and respective said contact-receiving slots of said wherealong respective said lamp leads extend from said lamp to a respective one of said power and common contacts, and said lead-terminating slots of said contact termination sections are aligned with respective said lead-receiving slots of said housing.

14. The lamp assembly as set forth in claim 13, wherein said assembly face of said housing includes a resistor-receiving recess along a said lead-receiving slot associated with one of said pair of lamp leads including a resistor disposed therealong.

15. The lamp assembly as set forth in claim 13 wherein said contacts include retention tabs at insertion ends thereof, and said contact-receiving slots include portions communicating with a surface along a side of said housing facing said mounting face for said retention tabs to pass through and extend beyond said surface, whereafter said retention tabs are bent to hold said contacts in said housing.

16. The lamp assembly as set forth in claim 15 wherein said lead-receiving slots include a slot bottom positioned to support a respective said lamp lead during contact insertion to urge said lamp lead into a said lead-terminating slot of said contact for electrical termination thereto.

17. The lamp assembly as set forth in claim 16 wherein said selected ones of said lead-receiving slots are narrower than others thereof to receive thereinto ones of said pairs of lamp leads that are smaller in diameter than the others thereof, and said selected ones of said lead-receiving slots extending to respective said power contacts are shallower than said others, and said lead-terminating slots of said power contacts have wider slot portions proximate entrances thereof communicating with narrower slot portions inwardly from said entrances, all whereby said lead-terminating slots of said contacts are adapted to establish an electrical connection with either of said lamp leads, with said shallower narrower lead-receiving slots supporting smaller diameter ones of said lamp leads during contact insertion to urge said smaller diameter lamp leads into said narrower lead-terminating slot portions.

18. The lamp assembly as set forth in claim 17 wherein said common contact includes wide lead-terminating slots for wider ones of said lamp leads and narrow lead-terminating slots for narrower ones of said lamp leads.

19. A lamp assembly comprising:

an insulative housing having a mounting face and an opposed assembly face and including at least one lamp-receiving aperture extending from said assembly face to entrances along said mounting face;

a lamp insertable into each said at least one lamp-receiving aperture and having a pair of leads;

each said entrance of said at least one lamp-receiving aperture being at least sufficiently open to permit illumination of a respective lens of a display panel to which the lamp assembly is to be mounted;

each said entrance includes a larger dimensioned entrance portion and a smaller dimensioned entrance portion, said larger dimensioned entrance portion adapted to receive thereinto an enlarged end of a respective said lens when the lamp assembly is being moved against said panel, and said smaller dimensioned entrance portion laterally of said larger dimensioned entrance portion is adapted to receive thereinto said enlarged lens end laterally thereinto, and said smaller dimensioned entrance portions of all said lamp-receiving aperture entrances extending laterally in a common direction from said larger dimensioned entrance portions enabling said housing to be urged laterally along said panel upon simultaneous receipt of said lens ends into said entrances.

20. The lamp assembly of claim 19 wherein said lamp assembly includes embossments surrounding each said lens upon mounting of the lamp assembly to the panel, to exclude light therefrom from sources other than the lamp associated with said lens, said embossments concluding in coplanar leading ends to abut the panel.

21. The lamp assembly as set forth in claim 19 wherein each said enlarged lens end seats behind a ledge extending from said larger dimensioned entrance portion to mostly surround a respective said smaller dimensioned entrance portion, and said housing includes resilient sections coextending from said mounting face to free ends engageable with the panel upon moving of said lamp assembly thereagainst for deflection of said resilient sections, whereafter said resilient sections maintain bias against the panel and in cooperation with said enlarged lens ends seated behind said ledges, defines a mounting arrangement retaining the lamp assembly to the panel.

22. The lamp assembly as set forth in claim 21 wherein centers of said larger dimensioned entrance portions are spaced and positioned in a trapezoidal pattern to coincide with an identical trapezoidal pattern of said lenses mounted to said panel.

23. The lamp assembly as set forth in claim 22 wherein said larger dimensioned entrance portions are elongated extending away from said smaller dimensioned portions, and said smaller dimensioned portions are elongated extending away from said larger dimensioned portions, whereby lenses mounted in a rectangular pattern are receivable into said larger dimensioned entrance portions during lamp assembly mounting, and are slidable into said smaller dimensioned entrance portions, while the lamp assembly remains complementary to and usable with lenses mounted in said trapezoidal pattern.

24. A lamp assembly comprising:

an insulative housing having a mounting face and an opposed assembly face and including at least one lamp-receiving aperture extending from said assembly face to entrances along said mounting face;

a lamp insertable into each said at least one lamp-receiving aperture and having a pair of leads; and a power contact associated with each said lamp and having a terminating section connected to one of said leads, and a common contact associated with the other of said leads and including a terminating section connected thereto, each said power and common contact including a contact section exposed for electrical connection to external power sources for powering said lamps;

each said entrance of said at least one lamp-receiving aperture being at least sufficiently open to permit illumination of a respective lens of a display panel to which the lamp assembly is to be mounted;

each said power and common contact includes a lead-terminating slot in said termination section enabling an assured electrical connection with a respective said one of said lamp leads by compression thereagainst;

said assembly face of said housing includes contact-receiving slots thereinto for each said power and common contact, and further includes a pair of lead-receiving slots in communication with each said lamp-receiving aperture and respective said contact-receiving slots of said wherealong respective said lamp leads extend from said lamp to a respective one of said power and common contacts; and said lead-receiving slots include a slot bottom positioned to support a respective said lamp lead during contact insertion to urge said lamp lead into a said lead-terminating slot of said contact for electrical termination thereto, whereby said contacts terminate to said lamp leads during assembly of said contacts into said housing after lamp assembly thereinto, and said contacts retain said lamps in said housing.

25. The lamp assembly as set forth in claim 24 wherein said assembly face of said housing includes a resistor-receiving recess along a said lead-receiving slot associated with one of said pair of lamp leads including a resistor disposed therealong.

26. The lamp assembly as set forth in claim 24 wherein said contacts include retention tabs at insertion ends thereof, and said contact-receiving slots include portions communicating with a surface along a side of said housing facing said mounting face for said retention tabs to pass through and extend beyond said surface, whereafter said retention tabs are bent to hold said contacts in said housing.

27. The lamp assembly as set forth in claim 24 wherein said selected ones of said lead-receiving slots are narrower than others thereof to receive thereinto ones of said pairs of lamp leads that are smaller in diameter than the others thereof, and said selected ones of said lead-receiving slots extending to respective said power contacts are shallower than said others, and said lead-terminating slots of said power contacts have wider slot portions proximate entrances thereof communicating with narrower slot portions inwardly from said entrances, all whereby said lead-terminating slots of said contacts are adapted to establish an electrical connection with either of said lamp leads, with said shallower narrower lead-receiving slots supporting smaller diameter ones of said lamp leads during contact insertion to urge said smaller diameter lamp leads into said narrower lead-terminating slot portions.

28. The lamp assembly as set forth in claim 27 wherein said assembly includes one said common contact, and said common contact includes wide lead-terminating slots for wider ones of said lamp leads and narrow lead-terminating slots for narrower ones of said lamp leads.

* * * * *